United States Patent [19]

Bennardo

[11] Patent Number: 4,727,984

[45] Date of Patent: Mar. 1, 1988

[54] IMPREGNABLE LOCKING SYSTEM

[75] Inventor: Gilbert Bennardo, Nice, France

[73] Assignee: Microtechnic S.A.M, Monaco

[21] Appl. No.: 830,328

[22] Filed: Feb. 18, 1986

Related U.S. Application Data

[63] Continuation-in-part of Ser. No. 755,149, Jul. 15, 1985, Pat. No. 4,577,750.

[30] Foreign Application Priority Data

Dec. 11, 1984 [FR] France ..... 84 19035
Nov. 5, 1985 [FR] France ..... 85 16475

[51] Int. Cl.[4] ..... A45C 13/10

[52] U.S. Cl. ..... 206/1.5; 206/461; 220/230; 220/315

[58] Field of Search ..... 206/461, 470, 1.5, 444; 220/230, 315, 327

[56] References Cited

U.S. PATENT DOCUMENTS 2,591,271 4/1952 Levgreth ..... 206/1.5
4,120,400 10/1978 Kotyuk ..... 206/1.5
4,300,674 11/1981 Davet ..... 206/1.5
4,319,684 3/1982 Backman et al. ..... 206/470
4,367,822 1/1983 Pasternack et al. ..... 206/1.5
4,437,560 3/1984 Szahler ..... 206/1.5

*Primary Examiner*—J. M. Moy
*Attorney, Agent, or Firm*—Erwin S. Teltscher

[57] ABSTRACT

Impregnable locking system of the fastening of display-boxes called "blisters", consisting of a box in two articulated halves having on the side opposite their hinge fastening flaps destined to be held one against the other by this system, characterized in that it consists of a clip destined to cover these two flaps, and between which is attached a transverse shaft, a vertical notch made in the flaps allowing this shaft to go through when the clip is put into place, two gears which being slid onto this shaft, between the outer side of each flap and the corresponding side of the clip. A device is provided so that these gears are constantly pushed towards each other, and once this clip is placed on the flaps, the gears come to rest in lodgings made in the outer sides of the flaps, thereby immobilizing the clip onto the flaps. An external device is provided to push the gears in the opposite direction to take them out of the lodgings so as to allow extraction of the clip and to free the flaps of the blister to allow its opening.

5 Claims, 15 Drawing Figures

Coupe verticale $P_2$

IMPREGNABLE LOCKING SYSTEM

BACKGROUND OF THE INVENTION

The present invention concerns a system for the impregnable locking of the fastening of display boxes commonly known as "blisters"; they consist firstly of box with two articulated halves destined to receive the product to be sold, and secondly of fastening parts, respectively interdependent of the halves, that are to be held one against the other by a fastening system, supposedly impregnable.

To avoid shoplifting, these blisters are of large sizes, therefore cannot be hidden, and only the personnel at the store's cash register have a device that allows it to open the fastening system and to give the product to the buyer.

However, the risks of theft remain high, since the blisters themselves, or their fastening system, can still be broken open, their impregnability being illusory.

The invention brings a satisfactory solution to this problem, due to a novel conception of these fastening parts and their immobilization system.

SUMMARY OF THE INVENTION

In its principle, the invention consists in the fastening parts of the box being external flaps destined to be held one against the other by the fastening system; this system consists of clips destined to cover the two flaps; between these flaps a horizontal shaft is passed, a vertical notch made in these flaps allows the shaft to be inserted when the clip is put into place. Two gears are slid onto the shaft beteen the outer side of each flap and the corresponding side of the clip; means are provided so that these gears are constantly pushed towards each other, so that once this clip is put into place on these flaps, the gears come to a stop in lodgings made in the outer sides of the flaps, therefore immobilizing the clip on the flaps. External means are provided to pull these gears in the opposite direction to take them out of the lodgings to allow the extraction of the clip, and to free the flaps of the blister, and to open it.

In practice, the means used for moving the gears, either into a fastening position, or into an opening position, can be mechanical, magnetic (permanent or electromagnets) or a combination thereof.

Therefore, according to a first realization, the first means consists of a pair of permanent magnets and the second means consists of an electromagnet attracting soft iron parts assembled in the gears in a stronger way than the mutual attraction of the permanent magnets.

According to a second realization, the first means consists of a pair of springs pushing the gears towards each other and the second means consists in a set of magnetic elements attracting a set of magnets assembled in the gears, preferably chosen from low density materials, such as ferrites or other agglomerated type magnets.

In the two cases, the opening means consists of a fixed tunnel in which the magnetic or electromagnetic elements are lodged, and into which the store cashier will put the clip, in such a way that the magnetic or electromagnetic elements exert an attraction on the gears superior to the forces, magnetic or mechanical, that are holding them in the lodgings in the flaps, and this frees the latter, allowing to open the blister.

In the hypothesis that such a system could still be broken into, in particular circumstances, for example, in the case, not of shop-lifting, but of a robbery in which stronger equipment might be used, a supplementary security assures the definite impregnability of the system. To this effect, the gears are rotatingly assembled between two stops on their common shaft, and the springs that are axially pushing them, exert at the same time a torsional pressure which pushes them against one of the stops; the external side of each gear and the corresponding internal side of the clip have a ridge/lodging couple which prevents the gears from moving away from each other as long as the rotating movement of the springs is not compensated by the use of the external magnetic elements.

In this case, means must be provided both in the "tunnel" mentioned before and on the flaps of the blister to unlock the gears once they are translating on their shaft and rotating, when the system is placed on the blister and when it is opened by the cashier.

To this effect, so as to mechanically compensate the torsional effect of the springs when the system is put into place on the blister, the top parts of the internal sides of the notches in the blister flaps have inclined gradients that co-operate with the corresponding gradients in the gears, causing their rotation while allowing enough space when the system is adapted to the blister.

As to the tunnel, according to the invention, the magnetic elements should be distributed with their poles opposite those of the corresponding gears and according to a motif slightly shifted during rotation to an angle corresponding to the rotation stroke against the stops pushed by the springs.

BRIEF DESCRIPTION OF THE DRAWINGS

The invention will now be described in greater detail, referring to the illustrative examples hereafter, corresponding to the annexed drawings in which.

DESCRIPTION OF THE PREFERRED EMBODIMENTS

Figure 1:
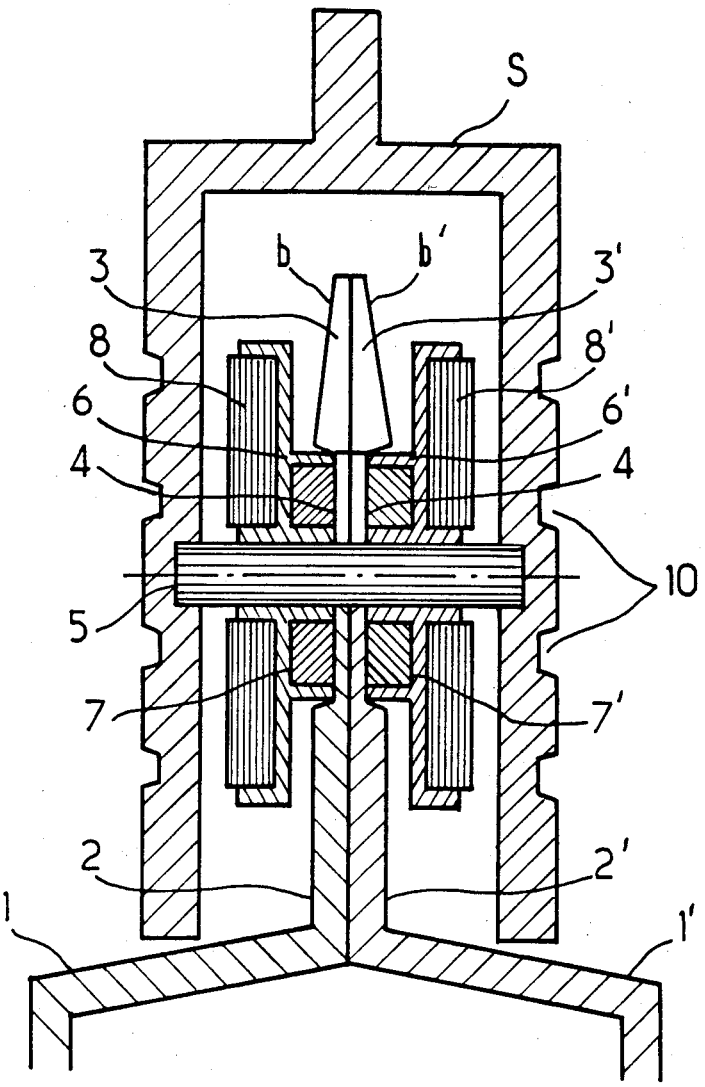
FIG. 1 is a cut-away of the top part of a blister equipped with a locking system according to a first realization of the invention.

If we first refer to FIG. 1, which schematically illustrates the principles of the invention, we see a "blister" that consists in a box in two halves 1 and 1', each interdependent on a flap 2 and 2'; these flaps are destined to be held against each other by a locking system designated by the general references S.

This system S has the shape of stirrup covering flaps 2 and 2' due to a vertical notch made in the top parts of these flaps, as shown by 3 and 3', letting through a crosswise shaft 5 on which two gears 6 and 6' slide; in the shown position, these gears come to a standstill in the lodgings 4 and 4' made in the outer sides of flaps 2 and 2'.

Two gears 6 and 6' have on one hand pairs of permanent magnets 7 and 7' and on the other soft iron plates, which play the following part:

When we cover the flaps 2 and 2' with the system S, the magnets 4 and 4' pull the gears towards each other so that when the clip is not placed on the blister, they are in contact with each other; whereas when the clip is inserted above the flaps, they are separated by bevels b and b' made in the top ends of the flaps; they follow the slope of these bevels as they separate, then, arriving in front of the lodgings 4 and 4', they each, return into the lodging, therefore locking the system over the flaps 2 and 2'.

It is therefore no longer possible to open the blister without an aid from the outside.

According to the invention, this aid consists in a sleeve that is the frame around an electromagnet whose spires fit into ridges designated by 10 on FIG. 1.

This sleeve is generally attached fixedly to the store's cash register post, and the operator can pass electricity to it when a blister to be opened is connected to it. When the current goes through, the magnetic field produced attracts the soft iron plates 8 and 8', in such a way that this attraction force is superior to the mutual attraction force of the magnets 7. It results in the two gears pulling apart from each other, leaving the lodgings 4 and 4', and therefore freeing the system that can be taken off of the flaps, and they in turn can be separated to open the blister.

This realization is totally satisfactory in principle, but in certain cases, there may remain a possibility of breaking the systems, e.g. by a shock on the system or by the use of extremely powerful magnetic materials, which would have the same effect on the two gears as the sleeve that is normally used.

This is why the variant shown in the following Figs. offers even more security.

Figure 2:
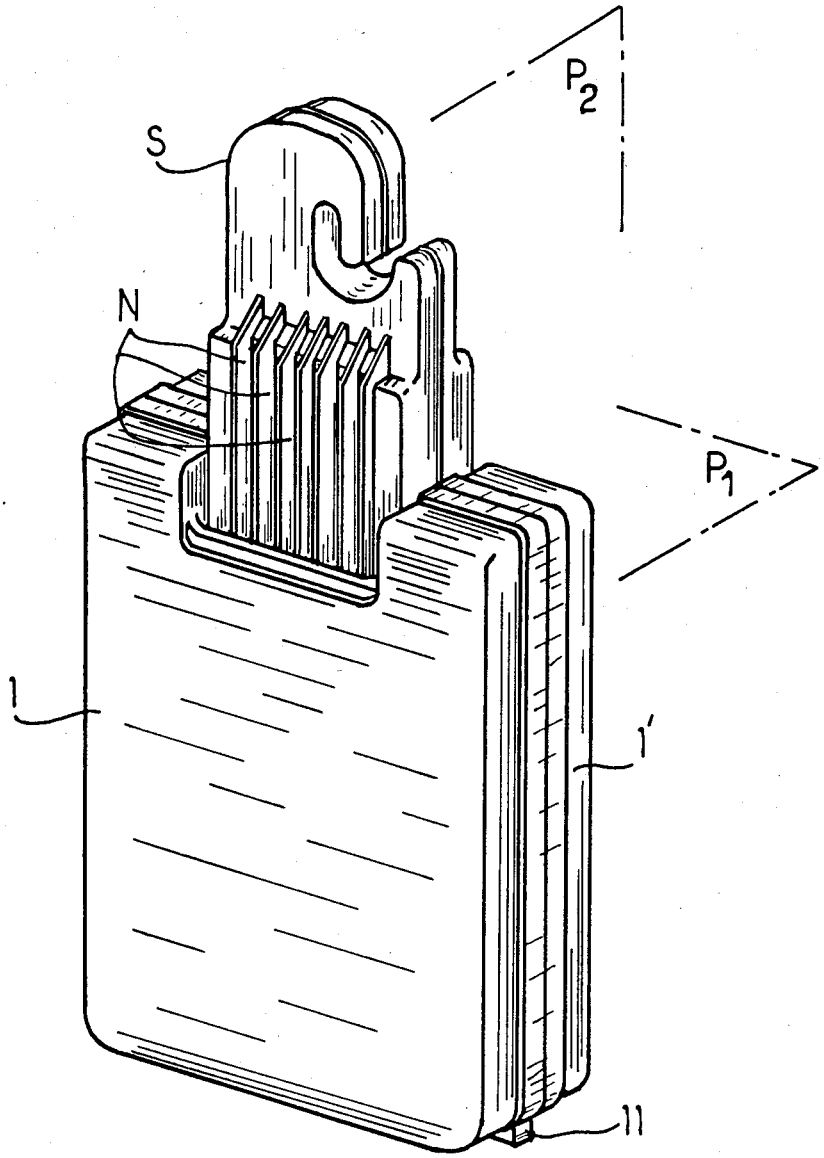
FIG. 2 is an overall view of a blister equipped with a locking system according to a second realization of the invention.
Figure 3:
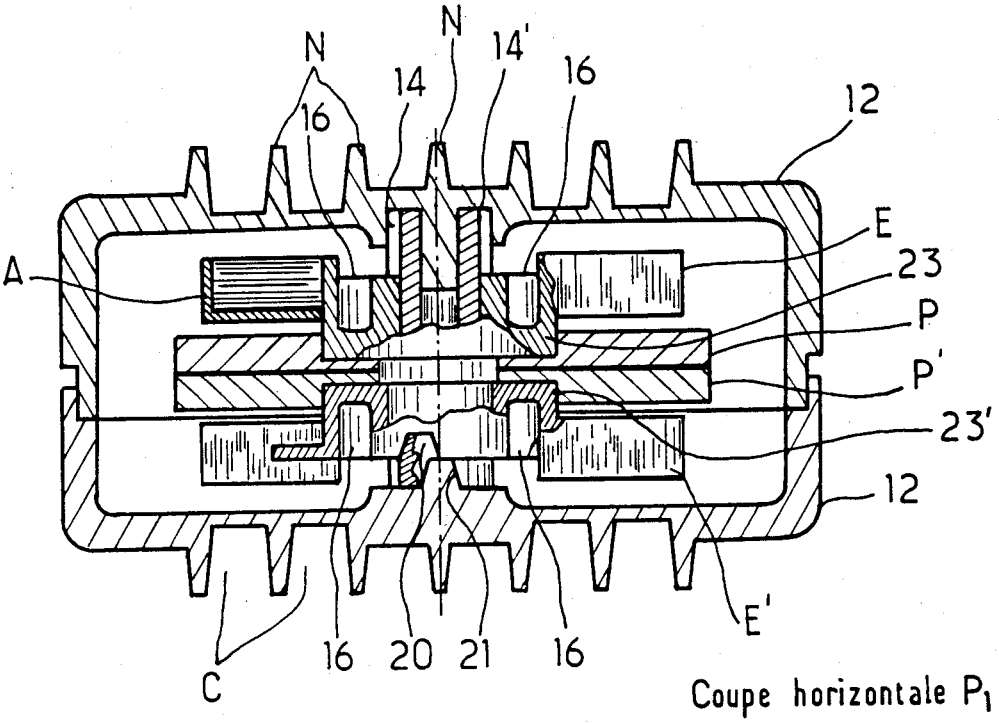
FIG. 3 is a horizontal cut-away according to a layout P1 of FIG. 2 of the locking system, according to the invention.
Figure 4:
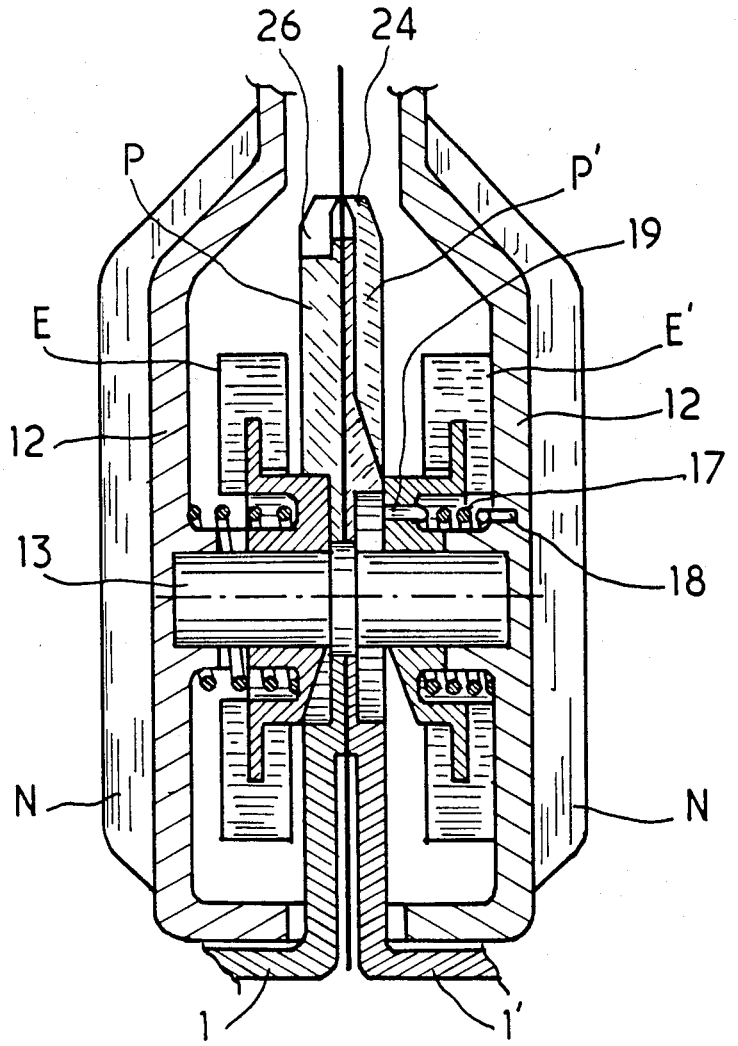
FIG. 4 is a vertical cut-away according to the layout P2 of FIG. 2 of the locking system shown in FIG. 3.
Figure 7:
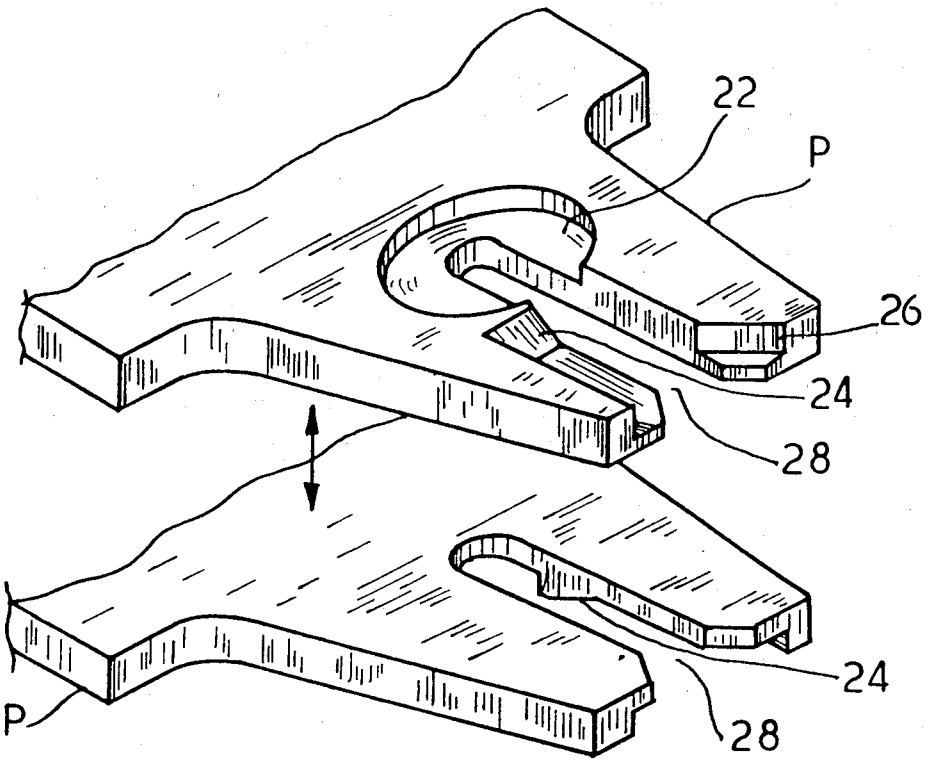
FIG. 7 is a view in perspective of both of the flaps that receive the locking system described in FIGS. 3–6.

If we first refer to FIG. 2, we can see, in perspective, on one hand, a blister again made of two halves 1 and 1' articulated around a shaft 11, the flaps of this blister, that appear notably in FIGS. 3 and 4, but are more specifically shown in FIG. 7, being covered by the locking system and designated by the general reference S.

Figure 5:
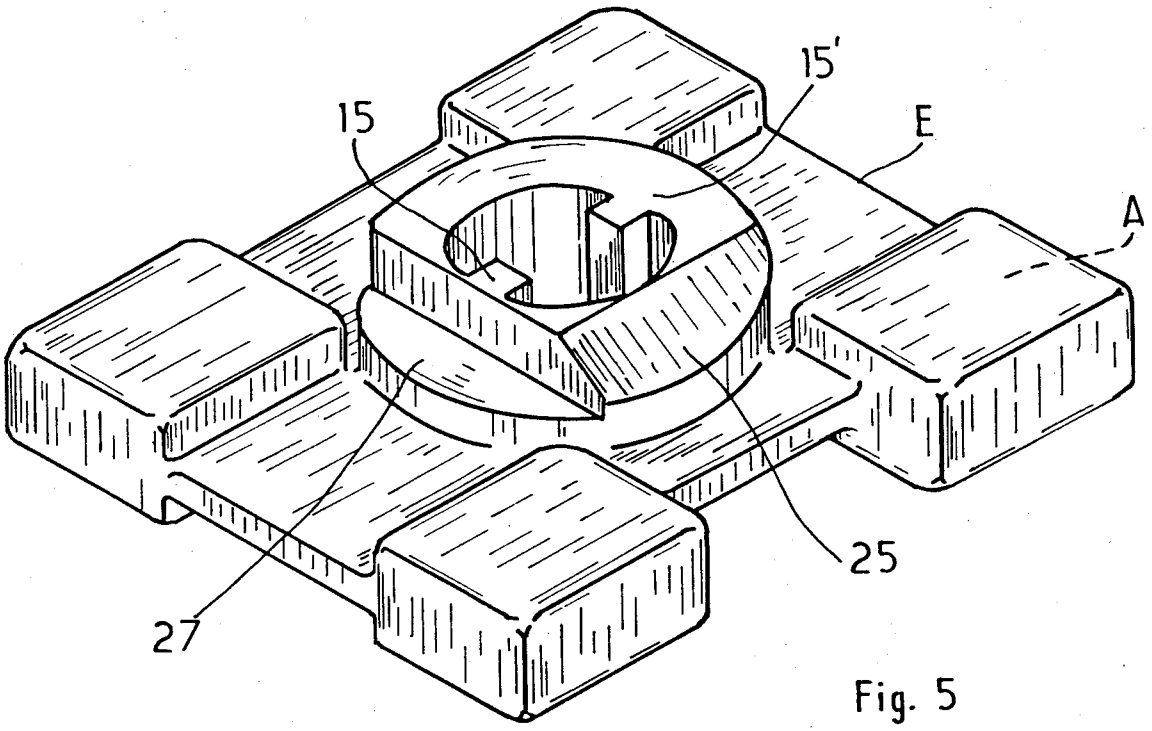
FIG. 5 is a view in perspective of one of the mobile gears that intervene in the same system.
Figure 6:
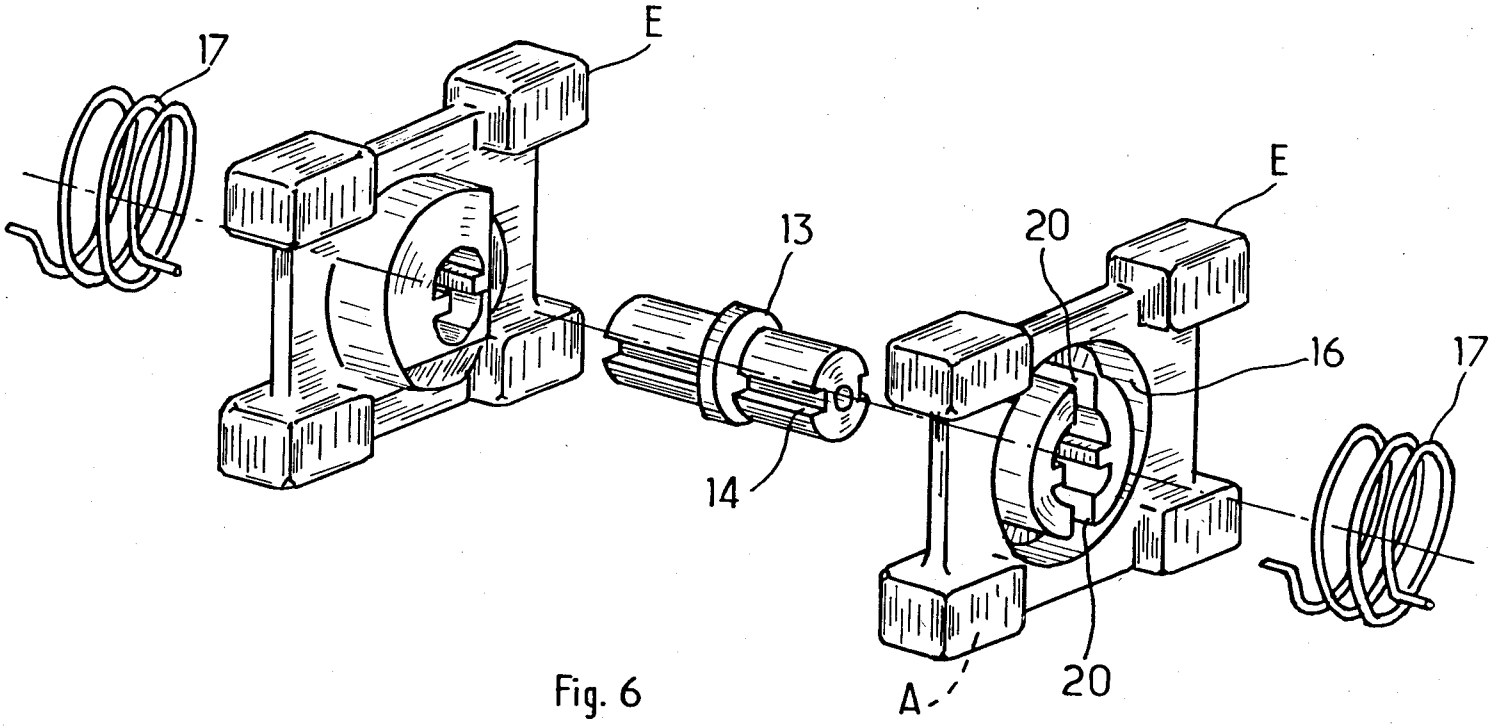
FIG. 6 is an exploded view of all of the gears and their controls.

This system S consists of two semi-pins 12 and 12' between which is attached a shaft 13, analogous to the shaft 5 of FIG. 1, i.e. two gears, like those shown in perspective in FIG. 5, and designated by the general reference E, slide on this shaft. However, this shaft has a particularity which appears more clearly in FIG. 6: along two opposite generators 14 and 14', two grooves are made to guide the two tenons 15 and 15' of each of the gears E.

Moreover, each of the gears E have a hollow sleeve 16 that is a lodging for a spring 17 which, as better seen in FIG. 4, has the particularity of acting both in compression and in torsion, these two ends 18 and 19 being immobilized on the edge of the gear E. Finally, the gear E has four permanent magnets A put together with the rest, and they are distributed at the four corners of a square.

The rotation effort transmitted by each of the springs 17 to the two gears E results in pushing back these gears in such a way that a notch 20 made in the body of each gear is put out of reach by a bump made on the internal side of the box 12.

Finally, in the same way as in the realization in FIG. 1, the two external sides of each of the flaps P and P' have a lodoing 22, as seen notably in FIG. 7, and it is destined to receive the opposite sides 23 and 23' of the gears E as seen in FIGS. 3 and 4.

Moreover, the external sides of flaps P and P' each respectively have two cam-slopes, respectively, namely 24 oriented in the longitudinal direction, and 25 oriented in the transverse direction, as seen clearly in FIG. 7.

These slopes are reversed in the flaps P and P' as seen in FIG. 7, so that the gears E and E' both respectively turn in the same direction, pushed by the springs 17, as will be explained in more detail herein below.

Considering only the system, i.e. before putting it on a blister, the two gears E and E' are pushed towards each other by the springs 17 and take a certain angular position also under the effect of the springs 17.

When the system is placed on the flaps of the blister, by inserting the shaft 13 into the notches 28 and 28' of the flaps P and P, cam-slopes 25 and 27 respectively of each gear E will cooperate with the cam-slopes 24 and 26 of the flaps, the first pair 26–27 making the gears turn in opposition to the spring 17, so as to bring the notch 20 in front of the bump 21 at the right time, while the co-operation between the cam-surface 24 and the cam surface 25 results in pushing apart the gears opposed to the compression of the springs 17, and this allows to bring the gears alongside each flap, until they fall back into their lodging 22.

At this moment the gears assure a double locking: first they assure a locking by a co-operation of the gears with the flap lodgings, in the same way as in FIG. 1, but in addition, any separating of the gears, accidental or malevolently on purpose, is made impossible because the gears are turned by the springs 17 in such a way that the bump 21 is no longer in front of the notch 20, and therefore the gears cannot be separated, except if they are submitted to a rotation in the opposite direction by the appropriate means.

These means are shown in FIGS. 8 to 11, which show the blister opening tunnel, used at a fixed post near the store's cash registers, that frees the system from the blister and allows the product to be given to the customer.

Note here that the boxes 12 of the system S have fine ribs N between which are very deep grooves designated by C, and they assure both the precise guiding of the systems into the blister opener and a deeper penetration of the blister opening element into the system.

Figure 8:
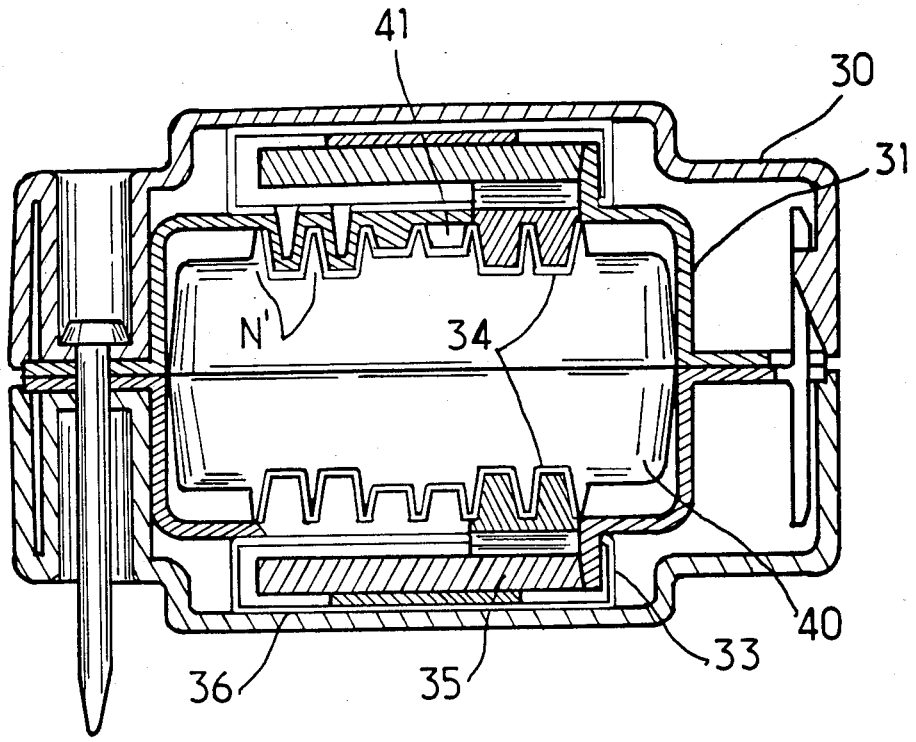
FIG. 8 is a vertical cut-away, transverse to the gliding shaft of the blister, of the blister-opening tunnel according to the invention.
Figure 9:
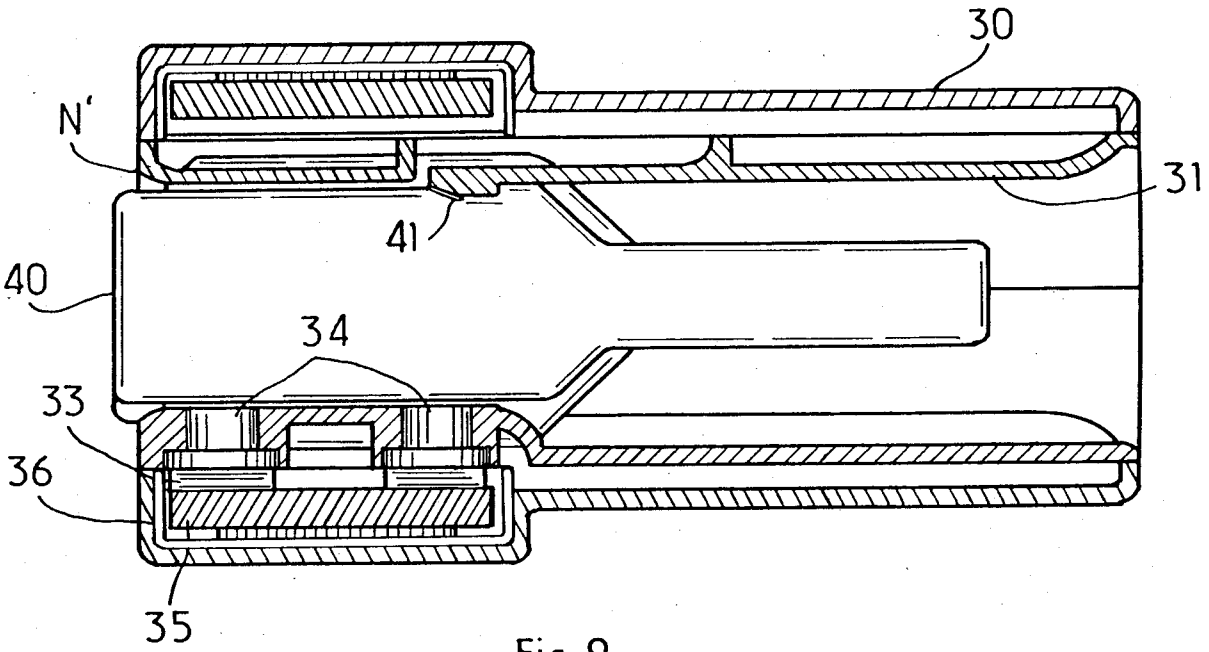
FIG. 9 is a lengthwise cut-away of the same blister opening tunnel.
Figure 10:
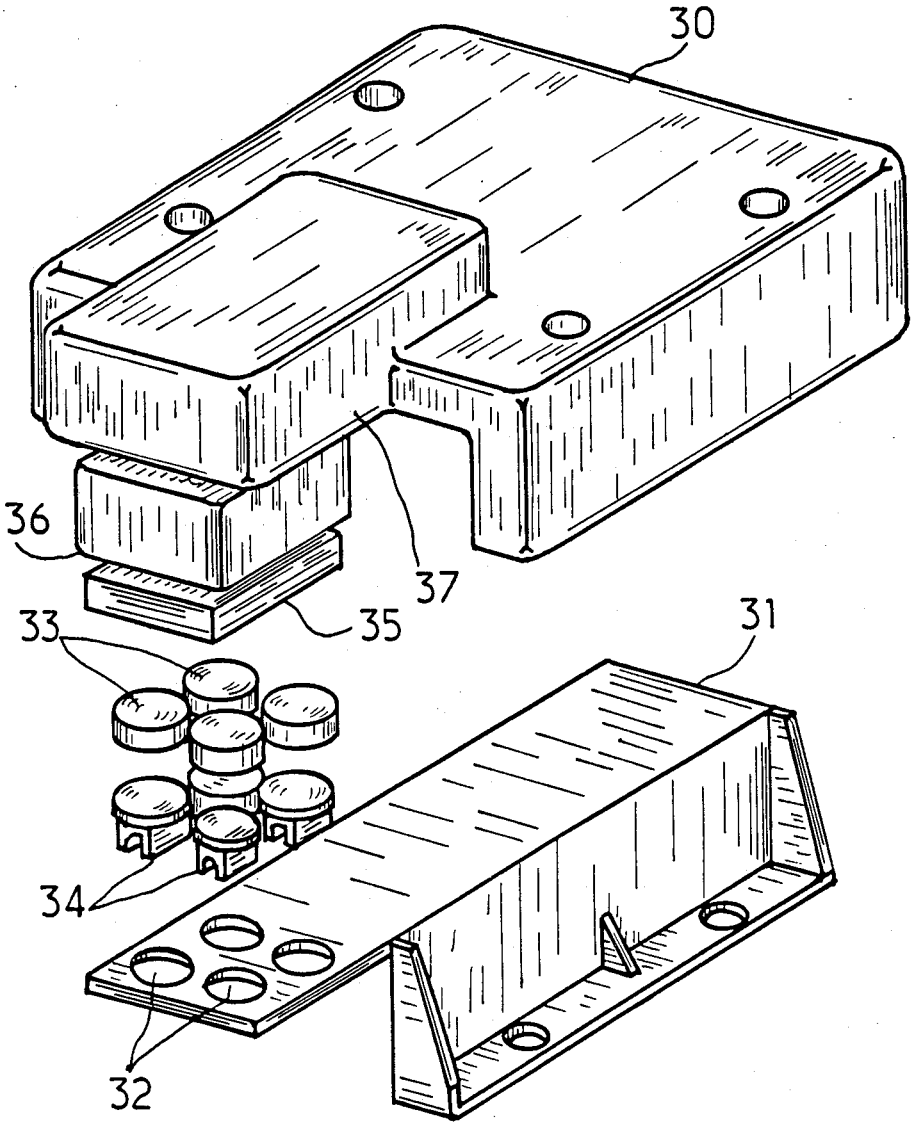
FIG. 10 is an exploded view of one of the halves of the blister.

If we now refer to FIGS. 8 to 10, we can see that this blister opener consists in a tunnel with a slightly rectangular section whose walls, at the opening, have ribs N' directed inwards, that correspond in number and in layout to the grooves C of the box of the system.

This therefore allows the inserting of the system whose parts are very similar to the active parts of the blister opening system.

The latter consists in, at the top and at the bottom, of a semi-hood 30, in which is lodged a semi-guide 31, perforated following 32 so as to receive four samarium-cobalt magnets 33, held by the polar parts 34, all of this being lodged in a cylinder head 35 to take it to an armor-sheeting 36 that is lodged in a chamber 37 of the semi-hood 30.

We see in FIG. 9 the layout of these magnets, placed at the four corners of a square.

This square has the same dimensions as both of the gears E, but since the gears E have turned after the placing of the system onto the blister flaps, when the locking system is inserted into the opening of the tunnel, designated by 40 in FIG. 9, the gap between the positions of the magnets of the mobile gears and of the magnets of the blister opening tunnel is such that the gears start rotating under the effect of the attraction of the magnets between themselves.

This rotating movement results in puttino the bump 21 and the notch 20 together in each gear, and the two gears are free to move axially along their shaft 13. Because of the mutual attraction of the magnets of the blister opening tunnel and of the gears, these two gears are pulled apart, and this frees the system and then allows extraction of the flaps from the locking system.

The locking systems stays in the tunnel from which it will be ejected towards the back when the next system to be unlocked is inserted.

A pawl 41 provided at the back of the active part of the blister opening tunnel prevents the locking system from being taken out of the tunnel when the freed blister is taken out.

As shown in the preceding description, due to the system according to the invention, we have the benefit of a double security, the first being assured by the system of axial moving of the gears, in a way that can be compared to the variant shown in FIG. 1, but with mechanical elements replacing the magnetic elements to hold the gears in place, and second, a security during rotation, obtained by the same mechanical means, and which prevents any mechanical accidental or malevolent opening of the blister, but with enough means to be stronger than the mechanical moving together of the two gears under the effect of the springs.

Figure 11A:
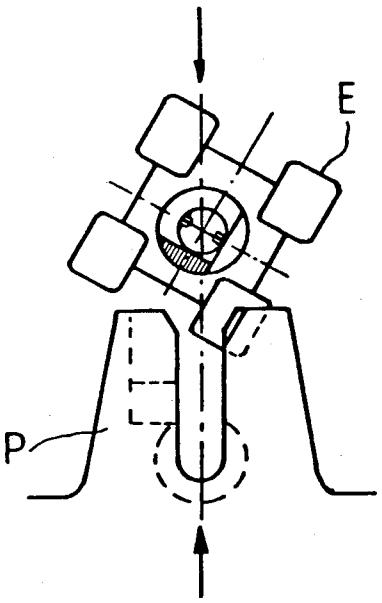
FIGS. 11*a*, 11*b* and 11*c* are three layouts showing the relative movements of the gears with respect to the flaps when the locking svstem is adjusted to the flaps of the blister.
Figure 11B:
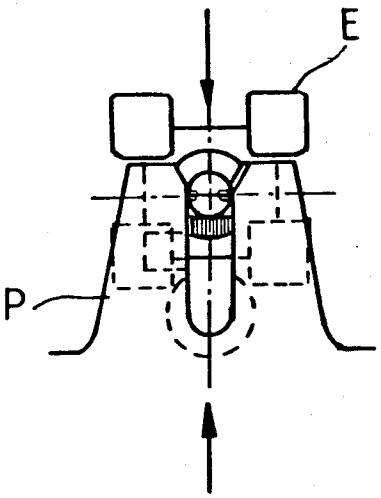
Figure 11C:
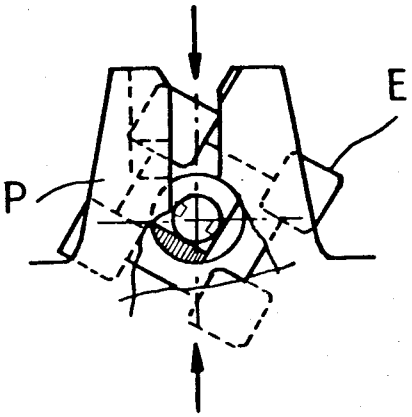

The only way to beat this double action is either to use the blister opener when the system is placed on the flaps, either the particular configuration of the flaps, such as illustrated notably in FIGS. 11*a*, 11*b*, and 11*c* which precisely show the three stages of putting the system into place:

In FIG. 11*a*, the two gears are either symetrical with respect to the flaps and to their shafts, then in FIG. 11*b* two pairs of cam-slopes cause the rotation of the gears which allows the system to be put into place, and then, in FIG. 11*c*, the system unlocks itself under the compression and the rotation of the springs.

Of course, other variations can be conceived, which of course will take after the same principle as seen in the claims hereinafter.

Therefore, to prevent the understanding of the functioning of the system, which will increase even more the security, it will preferably be made "invisible" in an opaque box.

In a preferred embodiment the hinged halves of the housing are in the shape of shells forming respectively a bottom and a cover which together provide an opening, letting through the neck of a bottle to be protected against theft, this pair of shells forming a recess for a strong wire whose two ends are fastened to the bottom and crossed so as to form a loop in the position of the opening, a device tightening up and locking the loop around the neck being fitted slidingly in the recess so as to be brought into a position where it applies its tightening and locking action irreversibly, when the housing is closed, and is free to abandon this position releasing the neck when the housing is opened.

The aforenoted specification describes a theft-proof locking system for the fastening of display cases, so-called "blisters", cosisting of a housing of two hinged halves, containing on the side opposite their hinge, locking lugs designed to be held against each other by this system, characterized in that it consists of a grip designed to cover the two lugs, and between which a transverse pin is fitted, a vertical groove made in the lugs providing the passage for this pin when the grip is installed, two sliding contacts being mounted on this pin between the outer side of each lug and the corresponding side of the pin, means provided for these sliding contacts to be continuously urged towards each other, so that once this grip is in place on the lugs, the sliding contacts place themselves in the recesses provided in the outer faces of the lugs, thus locking the grip on the lugs, external means being provided to urge the sliding contacts in the opposite direction so as to release them from the recesses, with a view of permitting extraction of the grip and releasing the lugs from the housing so as to open it.

An improvement covers an alternate version of the same locking system, applicable no longer only to a box or housing forming cases designed to contain a product proposed for sale, but to shells in whose opening a portion of the product proposed for sale can be locked in position, which is thus secured to the system, and the shape and dimensions of the product plus system assembly then becoming such that they are disuasive to any thieves.

Such a version applies both to products which have a shape and dimension making it difficult to insert them into a "blister", and notably bottles, and to far smaller but highly valuable objects, that are to be protected without necessarily completely enclosing them, notably owing to their particular shape, such as, for example telelenses, and the like.

For this purpose the improved system according to the invention, consists of a grip covering two lugs, which, once in position, can no longer be extracted to release the lugs without the external means provided, but the lugs, instead of being secured respectively to the two halves of the case or housing designed to enclose the product to be protected, are secured to half-shells acting as recess to a locking device which locks in position the product to be protected, remaining outside the shells, but the element whereof can be inserted through an opening common to the two shells, in the active element of the locking device.

As an example, the product to be protected being a bottle, the bottleneck is passed into the common opening of the shells, and locked in position by the locking device, which can then only be released by opening the shells, by means of the system covered in the earlier description. The device has a general shape and dimension such that, once thus coupled to a bottle, it makes concealment and hence, theft, impossible.

A favorable embodiment of this invention is of the locking device consisting of a strong, flexible wire, for example, metal or suitable plastic, forming a loop through which the neck of the bottle is strung, and which is tightened by a plunger sliding between the two shells and containing unidirectional retaining elements, such as sawtooth serrations cooperating with the corresponding elements of one of the shells so that, once brought into the locking position, this plunger can only be withdrawn, releasing the loop, by opening the two shells, in accordance with the previous description.

Figure 12:
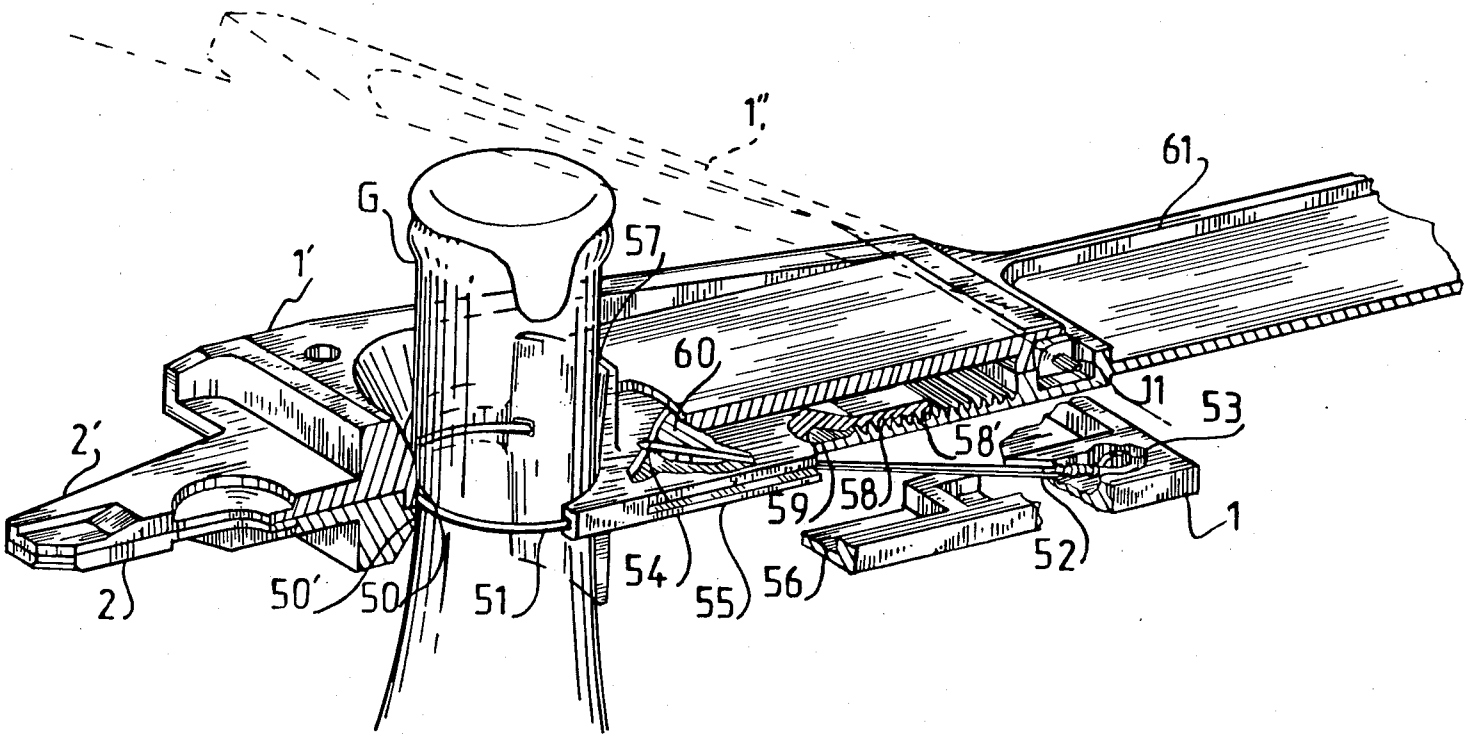
FIG. 12 is a perspective view with partial tear-away of the device according to the invention, in bottle locking position and, FIG. 13 shows the plunger of FIG. 12 in perspective.
Figure 13:
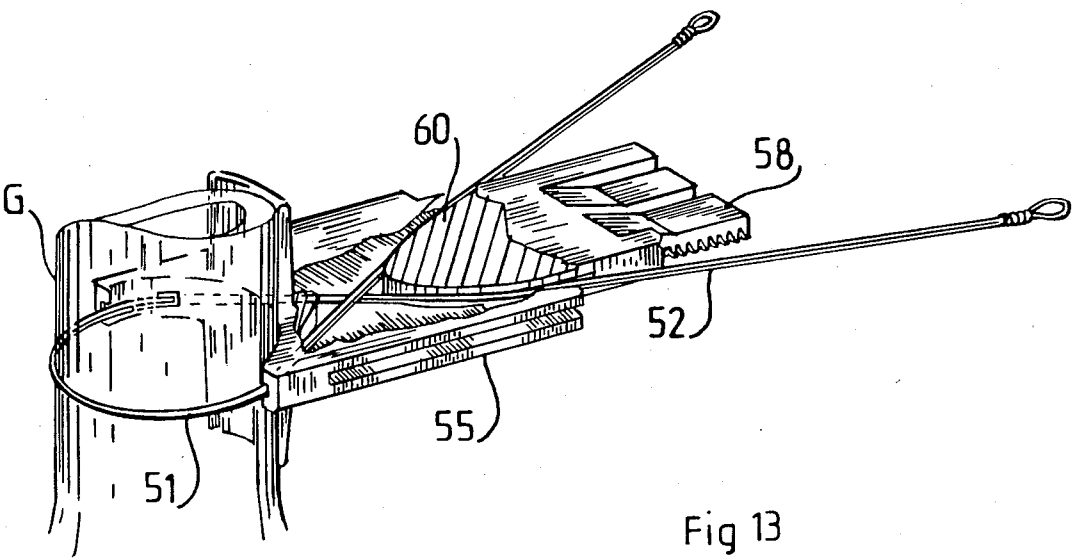

Referring now to FIGS. 12 and 13, these show lugs 2 and 2' of a case 1 and 1', which this time consists of two flat shells, shell 1, considered as the bottom of the case, on which shell 1' is hinged, around hinge 11, shell 1' being considered as a cover. These lugs are connected in a theft-proof way by the system according to the previous description.

According to the invention, the assembly 1—1' contains an opening 50, 50' designed to let through the neck G of the bottle to be protected, and within the space of this opening lies a loop 51 of a wire 52, fastened at both ends to studs 53 secured to bottom 1, and crossing on itself in 54.

In the unlocked position, loop 51 is loosened enabling the neck G to be inserted into and extracted from the opening 50—50'.

To lock neck G, i.e., couple it irreversibly with shells 1—1', a locking device is provided, consisting of an element fitted slidingly between the two shells. This element consists of a plate 55 (FIG. 13) whose travel is guided by edges 56 of bottom 1, and containing in its front part a partition 57, providing for handling, and in its rear part serrations 58 directed towards the rear and cooperating with corresponding serrations 58' in bottom 1, when cover 1' forces it against bottom 1 via a flexible lug 59. On its upper face plate 55 contains a triangular block 60 acting as a wedge whose rounded point positions itself in the angular of interception 54 of wire 52.

The device then operates as follows:

Shells 1—1' being closed against each other, plate 55 is forced against bottom 1 in the rear position. The neck G is then. inserted into the opening 50 and loop 51.

Keeping the shells stationary, then the plunger 57 is pressed, whose block forming wedge 60 moves aside the two strands of wire 52, applying a tractive force to them whilst tightening loop 51 bringing intersection 54 practically in contact with the neck, which is then captive in this tight loop. Any loosening is made impossible by the locking of plate 55, any return movement backwards being prevented by serrations 58–58'.

The device is thus coupled irreversibly to the bottle. If, as shown, the bottom 1 is followed by a large size flange 61, the assembly that it forms with the bottle corresponds to such an angular volume that it becomes impossible to conceal, thus preventing the bottle from being stolen.

To release the bottle, at the cash till, it is simply necessary to release lugs 2—2'. in accordance with the previous description, enabling the cover 1' to be lifted by 1'', releasing the pressure on 59, which in turn separates serrations 58 and 58', thus enabling plate 55 to be withdrawn, loosening loop 51.

A flexible element (not shown) can consist in the withdrawal of plate 55 thus released, which increases the simplicity of "resetting" the device: as plate 55 withdraws automatically, it is simply necessary to reclose shells 1—1' and lugs 2—2' to have the device ready for use again.

It must be understood that the use of this kind of impregnable locking is not limited to this application on blisters, but may be extended to all of the cases when a closed mobile box is to be made impregnable, e.g. the "lead sealing" systems of safes, cases, attache-cases, containers and analogous devices.

What is claimed is:

1. Impregnable locking system for the fastening of display boxes called "blisters" consisting of a box of two halves having on a side opposite a hinge thereof fastening flaps intended to be held one against the other, comprising in combination a clip arranged to cover said flaps, and between which there is attached a transverse shaft; a notch formed in the flaps allowing said shaft to pass through when said clip is put into place, two gears being slid onto said shaft between an outer side of each flap and a corresponding side of said clip, means being provided so that said gears are constantly pushed towards each other, and once said clip is placed on said flaps, said gears come to rest in lodgings made in outer sides of the flaps, thereby immobilizing the clip onto said flaps, external means being provided to push said gear in an opposite direction to take them out of said lodgings so as to allow the extraction of said clip and to free the flaps of the blister to allow its opening, and wherein the hinged halves of the housing are in the shape of shells forming, respectively, a bottom and a cover, which together provide an opening adapted to let through the neck of a bottle to be protected against theft, the pair of shells forming a recess for a strong wire whose ends are fastened to said bottom and crossed so as to form a loop in the position of the said opening, means tightening up and locking said loop around said neck being fitted slidingly in the said recess so as to be brought into a position where it applies its tightening and locking action irreversibly, when said housing is closed, and is free to abandon this position so as to release the neck when the housing is opened.

2. The system as claimed in claim 1, in which said locking means comprises of a plate containing on an upper face thereof a triangular wedge forming block directed towards an intersection point of two strands of said wire, so that when said plate slides forwardly, it separates the strands of the wire and tightens the loop, undirectional retaining means being provided to prevent the return of the plate backwards when the two shells are closed.

3. The system as claimed in claim 2, wherein said unidirectional retaining means comprises two sets of transverse serrations directed towards the rear, provided respectively on a lower face of the rear of said plate and on an upper face of the bottom of said box, said sets cooperating with each other when the two shells are closed, optionally applying a vertical pressure to the plate.

4. The system as claimed in claim 3, wherein an edge on the front of said plate applies a sufficient thrust to the latter to lock the loop of the wire in position around the neck.

5. The system as claimed in claim 3, wherein a flexible element forces the plate to the rear.

* * * * *